United States Patent [19]

Schloemann

[11] Patent Number: 4,789,844

[45] Date of Patent: Dec. 6, 1988

[54] BROAD-BAND NON-RECIPROCAL MICROWAVE DEVICES

[75] Inventor: Ernst F. R. A. Schloemann, Weston, Mass.

[73] Assignee: Raytheon Company, Lexington, Mass.

[21] Appl. No.: 56,938

[22] Filed: May 29, 1987

[51] Int. Cl.[4] ..... H01P 1/387

[52] U.S. Cl. ..... 333/1.1; 333/24.1

[58] Field of Search ..... 333/1.1, 24.1, 24.2

[56] References Cited

U.S. PATENT DOCUMENTS

| | | | |
|---|---|---|---|
| 3,080,536 | 3/1963 | Dewhirst | 333/24.1 |
| 3,334,317 | 8/1967 | Andre | 333/1.1 |
| 3,425,001 | 1/1969 | Hershenov | 333/24.1 |
| 3,555,459 | 1/1971 | Anderson | 333/1.1 |
| 3,614,670 | 10/1971 | Wilson | 333/1.1 |
| 3,922,620 | 11/1975 | Deutsch | 333/1.1 |
| 4,254,384 | 3/1981 | Piotrowski et al. | 333/1.1 |
| 4,276,522 | 6/1981 | Coerver | 333/1.1 |
| 4,390,853 | 6/1983 | Mathew et al. | 333/1.1 |
| 4,496,915 | 1/1985 | Mathew et al. | 333/1.1 |

FOREIGN PATENT DOCUMENTS

| | | | |
|---|---|---|---|
| 105403 | 8/1980 | Japan | 333/1.1 |

*Primary Examiner*—Paul Gensler

*Attorney, Agent, or Firm*—Denis G. Maloney; Richard M. Sharkansky

[57] ABSTRACT

A stripline circulator includes a pair of dielectrically supported ferrite discs and a pair of spaced hemispherical ferrite caps each one disposed over a corresponding one of the ferrite discs. The ferrite caps provide in combination with the ferrite discs a uniform DC magnetic field within the ferrite discs to reduce the insertion loss of the circulator at frequencies less than the so-called magnetization frequency of the ferrite material and thus, extend the operating bandwidth of the circulator. The ferrite caps are spaced from the ferrite discs by a thin layer of metallization having a thickness larger than the skin depth thickness of a microwave signal over the desired microwave frequency band. The ferrite discs are preferably comprised of signal crystalline ferrite materials oriented in a hard-axis orientation which generally is the [100] direction for materials where the first order anisotropic constant $K_1$ is negative.

31 Claims, 8 Drawing Sheets

BROAD-BAND NON-RECIPROCAL MICROWAVE DEVICES

BACKGROUND OF THE INVENTION

This invention relates generally to microwave devices and more particularly to nonreciprocal microwave devices such as circulators and isolators.

As is known in the art, energy transfer between two or more ports may be provided by non-reciprocal devices such as circulators and isolators. In particular with circulators, energy fed to an input port of the circulator is transferred to an output port of the circulator whereas input energy fed to the output port of the circulator is not efficiently transferred to the input port of the circulator and, therefore, such a device is generally referred to as a non-reciprocal device. One type of circulator commonly employed in the art is a so-called junction circulator which can be comprised of either a stripline transmission medium or microstrip transmission medium, for example. Commonly, such junction circulators are provided with three ports and are generally referred to in the art as Y-junction circulators. The basic construction of a stripline Y-junction type circulator includes a center patterned conductor having three stripline branches connected to a central portion. The center conductor is sandwiched between a pair of dielectrics which dielectrically space said central conductor from a pair of ground planes disposed over second surfaces of the pair of dielectrics. Disposed in said dielectrics is a pair of discs comprised of a ferromagnetic material which exhibits gyromagnetic action. Commonly, materials such as ferrites and garnets are used to provide the gyromagnetic action. The ferromagnetic materials are disposed within the presence of a DC magnetic field. Input energy fed to an input one of the branches of the circulator is transferred either to a clockwise disposed or counter-clockwise disposed adjacent output one of the ports of the circulator in accordance with the polarity of the DC magnetic field fed through the ferrite disc members.

Generally, circulators are relatively narrow band devices capable of operating with acceptably low insertion loss and relatively high isolation over about an octave of bandwidth. A device having an octave bandwidth has an upper frequency limit which is equal to twice the lower frequency limit of the device. Accordingly, a circulator which operates at a low frequency of 2 GHz having an octave bandwidt would have an upper frequency limit of 4 GHZ.

Two types of circulations are known in the art. The first type, the so-called "edge mode" circulator is arranged to have the energy traveling through the ferrite medium concentrated near one of the edges of the center patterned conductor. Circulator action is provided at the junction. As the energy propagates towards the junction, it will propagate towards the port which is closest to the edge at which the energy was concentrated. The second type of circulator operates in a mode as described by Wu and Rosenbaum in an article entitled "Wideband Operation of Microstrip Circulators MTT 22, Pages 849–856, October 1974. Here, the ferrite members operate as dielectric resonators.

Many attempts have been made in the prior art to increase the bandwidth of circulators. Two such attempts are described in U.S. Pat. No. 3,555,459 by Anderson for what is here considered circulator and U.S. Pat. No. 4,496,915 by Mathew et al for dielectric resonator mode circulators.

In the '459 patent broad-band performance was provided by attempting to reduce or supress various undesired modes at the upper end of the band by arranging the central conductor of a stripline type circulator to have smooth and tapered branch legs connected to a central portion. The tapered legs were free of abrupt changes in direction to assure that the rate of change of the edges of the conductor was less than the rate of circulation of a TEM mode wave in a transversally magnetized ferrite so that no large mismatches occurred which would otherwise increase the frequency sensitivity of the device. Patentee further describes the use of mode suppressing techniques which involved placing a lossy dielectric material adjacent the ferrite disc to suppress undesired higher order modes. This is an example of an "edge mode" propagation circulator. Broad band performance is achieved at the expense of size. That is, in order to concentrate energy at the edge of the stripline medium, relatively large diameter ferrite discs (i.e. 1.0 in. to 3.0 in.) are required.

A solution to increasing the bandwidth of microwave circulators, which operate on the principal described by Wu and Rosenbaum, is described in the '915 patent to Mathew. Patentee uses a composite ferrite disc between the central conductor and ground planes of the circulator circuit. The composite ferrite disc includes two concentric members, with each member comprised of a different ferrite material and with one member being disposed within the periphery of the other member. The two materials are selected to provide different frequency characteristics over the frequency passband of the circulator. This approach requires relatively difficult fabrication techniques to provide the composite ferrite, which may increase the cost of such circulators. Further, this approach also increases the diameter of the ferrite discs, thus making the circulator larger.

In each of these references as well as the art in general, the lower limit on the bandwidth of circulator operation is recognized to be at a frequency known as the magnetization frequency $f_m$, which is given by $2\gamma f_m = \pi 4\gamma M_s$ where $\gamma$ is is the gyromagnetic ratio of the ferrite and $4\pi M_s$ is the saturation magnetization of the ferrite. Available ferrite materials have $f_m$ values from a fraction of a GHz up to approximately 14 GHz. The bandwidth of conventional circulators is limited on the low end at $f_m$ by the onset of a phenomena known as "low field loss".

At the high end of the frequency bandwidth, the frequency band of circulators is limited by the fact that the gyromagnetic effects of ferrite material generally become small as the frequency is increased.

With the approaches discussed above, several problems exist particularly for applications which require small, compact circulators. Patent '459 achieves improved broadband performance by mode suppression, rate of circulation matching, and use of relatively large ferrite discs which provide an edge mode propagation type of circulator. Thus, while the bandwidth of the '459 device is shifted towards $f_M$, it comes at the expense of requiring the use of a very large ferrite disc. Patent '915 achieves improved broad-band performance by using a composite ferrite disc located within the magnetic circuit of the circulator. With this arrangement, construction of the circulator becomes more difficult. Further, the composite disc also increases the size of the circulator. For certain applications such as in a transceiver of a phased array antenna, circulator size is extremely important since spacing of antenna elements on the face of the phased array is related to the wavelength of the energy being transmitted and received.

SUMMARY OF THE INVENTION

In accordance with the present invention, a nonreciprocal microwave device includes a propagation medium, means including a ferromagnetic material disposed within said propagation medium for providing non-reciprocal ferromagnetic interaction, said means having a predetermined low frequency cut off frequency $f_M$ related to the saturation magnetization of the ferromagnetic material, and means, disposed outside of said propagation medium, for providing ferromagnetic interaction below the low frequency cut off, $f_M$, of said ferromagnetic interaction means. With this arrangement, increased broad-band circulator action is provided at frequencies below $f_M$ the low field loss frequency of the nonreciprocal microwave device.

In accordance with a further aspect of the present invention, a microwave device includes means for providing circulator action including a propagation medium which includes a patterned conductor, a dielectric having an aperture supporting said patterned conductor, and an outer conductor disposed over an opposite surface of said dielectric. The circulator means further includes at least one disc of ferromagnetic material disposed in the aperture in said dielectric. The means for providing circulator action is disposed within a D.C. magnetic field, and means for increasing the uniformity of the internal D.C. magnetic field within the disc is provided adjacent to the ferrite disc but outside of the propagation medium. In a preferred embodiment, the means for increasing the D.C. magnetic field uniformity includes a pair of hemi-ellipsoidial bodies, preferable substantially hemispherical members each comprising a second ferrimagnetic material, said members being disposed over said ferromagnetic disc member to form in combination with said ferromagnetic disc member a substantially ellipsoidial, preferable spherical composite ferromagnetic body. With this particular arrangement, by providing the pair of ferromagnetic hemi-ellipsoidial members, preferably hemispherical members over the ferromagnetic disc member, the internal D.C. magnetic field in the ferrite disc will be substantially uniform and, accordingly, circulator operation will-occur at frequencies substantially below $f_M$, thereby increasing the bandwidth of the microwave device.

In accordance with a further aspect of the present invention, the means for increasing the uniformity of the D.C. field includes a second pair of discs comprised of a second ferromagnetic material disposed over the first ferromagnetic discs, external to the propagation medium. Means are provided for forming an external magnetic flux return path through the first and second ferrite discs. With this particular arrangement, the second pair of discs and external magnetic flux return path also improves the uniformity of internal magnetization provided in response to an applied D.C. magnetic field in the first ferrite disc and, thereby enable circulator action to occur at frequencies below $f_M$.

In accordance with a further aspect of the present invention, the propagation medium further includes a second dielectric and a second outer conductor disposed on second opposing side of the patterned conductor such that the patterned conductor is dielectrically spaced from the first and second outer conductors. A second ferrite disc is disposed in an aperture provided in the second dielectric. The means for increasing the uniformity of the internal D.C. magnetic field within each of the ferrite discs is disposed adjacent to the pair of discs but external to the propagation medium. The means for increasing the internal D.C. magnetic field uniformity may comprise a pair of hemi-ellipsoidial members, preferable a pair of substantially hemispherical members disposed over the pair of ferromagnetic discs to provide a substantially ellipsoidial, preferably spherical composite ferromagnetic body, or a second pair of ferromagnetic discs and a flux return path. With this arrangement, a stripline version of a circulator having an internal magnetic field at frequencies below $f_M$ is provided, thereby enabling operation of such a circulator substantially below the magnetization frequency $f_M$.

BRIEF DESCRIPTION OF THE DRAWINGS

The foregoing features of this invention, as well as the invention itself, may be more fully understood from the following detailed description read together with the accompanying drawings, in which:

FIGS. 4A–4C are plots showing calculated insertion loss, isolation, and reflection as functions of frequency for a stripline circulator, as described in conjunction with FIGS. 1–3;

FIGS. 5A–5C are measured insertion loss, isolation, and reflection of a circulator, as described in conjunction with FIGS. 1–3 using yttrium ion garnet;

FIGS. 7A–7C are plots of insertion loss, isolation, and reflection versus frequency for a circulator fabricated in accordance with FIGS. 1–3 using lithium ferrite;

DESCRIPTION OF THE PREFERRED EMBODIMENT

Figure 1:
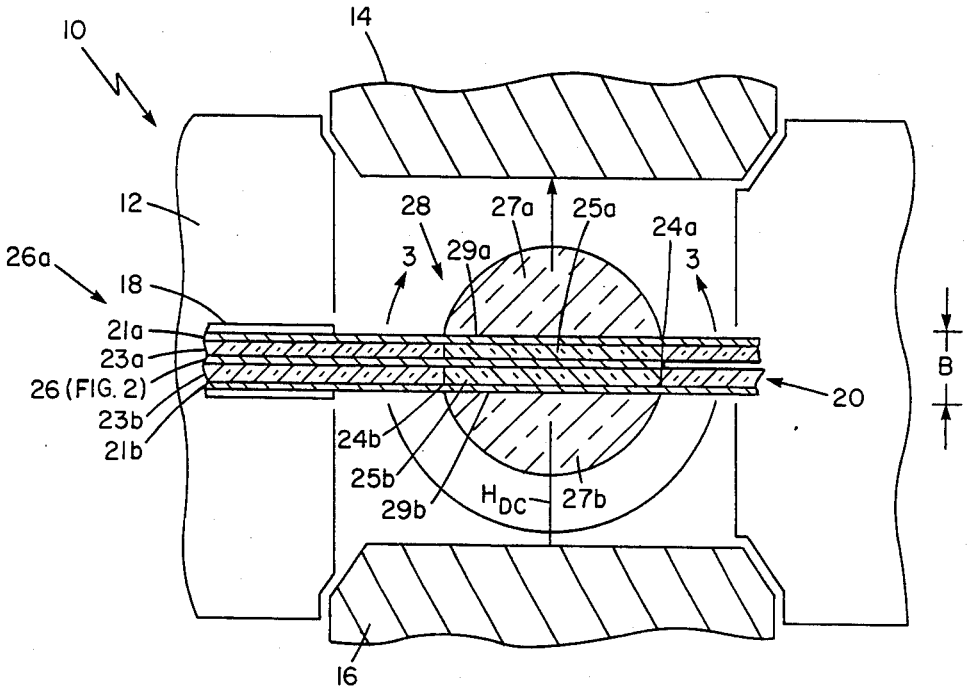
FIG. 1 is a cross-sectional view of a circulator having means to increase the DC magnetic field uniformity.
Figure 2:
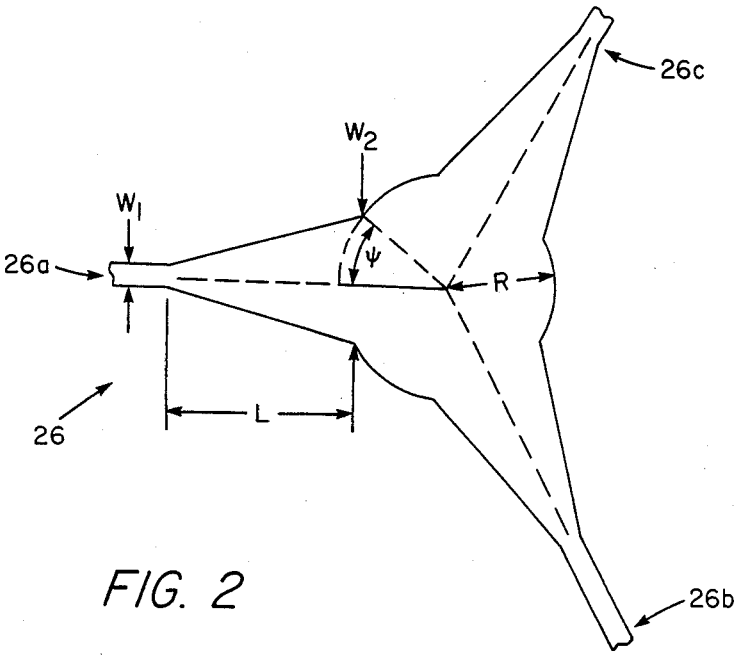
FIG. 2 is a plan view of a center conductor of the circulator shown in FIG. 1.

Referring now to FIGS. 1 and 2, a circulator 10 having three ports 26a–26c, is shown to include a housing 12, magnet structures 14 and 16, which provide a DC magnet field $H_{DC}$, and a circulator member 20 disposed through the D.C. magnetic field $H_{DC}$. Circulator member 20 is supported in housing 12 by member 18 which is here comprised of a conductive, nonmagnetic material. Circulator member 20 here comprises a stripline transmission medium having a central patterned conductor 26 (FIG. 2), dielectrically spaced on either surface thereof by a pair of dielectric substrates 23a, 23*b*, said substrates 23*a*, 23*b* having disposed over respective second surfaces thereof, ground plane conductors 21*a* and 21*b*, as shown. Disposed through dielectics 23*a* and 23*b* are apertures 24*a*, 24*b* having disposed therein respectively one of a pair of ferromagnetic disc members 25*a*, 25*b*, as shown. Disposed over the ferromagnetic disc members 25*a*, 25*b* are here a pair of ferromagnetic hemispherical members 27*a* and 27*b* disposed in a manner to provide a substantially spherical, composite ferromagnetic member 28. The pair of hemispherical members 27*a*, 27*b* are spaced from the pair of ferromagnetic discs 25*a*, 25*b* by a corresponding pair of conductors 29*a*, 29*b*, as shown. The DC magnetic field $H_{DC}$ is thus directed through the composite ferromagnetic member 28, here said ferromagnetic member 28 being substantially spherical. By providing a substantially spherical ferromagnetic composite member 28, the internal DC magnetization within the ferromagnetic members 25*a* and 25*b* will be substantially uniform. A substantially uniform internal D.C. field will permit operation of the circulator even at frequencies of microwave signals coupled amongst ports 26*a*–26*c* less than $f_m$, the magnetization frequency of the ferromagnetic material. The metalization layers 21*a*, 21*b* separate the discs 25*a*, 25*b* from the hemispherical members 27*a*, 27*b*, and thus place said members external to the propagation medium of the circulator 10.

Although hemispherical members are shown, hemi-ellipsoidial members may be used to increase the D.C. magnetic field uniformity within ferrite discs 25*a*, 25*b*.

Preferably, the hemispherical members 27*a* and 27*b* are comprised of a polycrystalline ferromagnetic material having similar saturation magnetizations as the material of the discs 25*a*, 25*b* and preferably are a ferrite or a garnet material, whereas the discs 25*a* and 25*b* are preferably comprised of a single crystalline ferromagnetic material, and preferably are a ferrite or a garnet. Two suitable materials for use for members 25*a*, and 25*b* are garnets such as yttrium iron garnet (YIG) or ferrites such as lithium ferrites.

To obtain useful circulator performance at frequencies lower than $f_M$ with small radius discs, without adversely affecting performance at the upper end of the band, a magnetic circuit configuration is provided in which the DC magnetic field strength in the interior of the ferromagnetic discs 25*a*, 25*b* is substantially uniform. Means are disposed over discs 25*a*, 25*b* to provide this uniform field in discs 25*a*, 25*b*. One technique, as shown, for achieving this desired uniformity is to position hemispherical members comprised of a material with substantially the same saturation magnetization as the discs, external to the microwave circuit but in close proximity to the discs. Hemispherical members 27*a*, 27*b* are separated from discs 25*a*, 25*b* by layers 29*a*, 29*b* of conductive material 21, as shown. The conductive layer thickness is small as possible, but is significantly larger than the skin depth at the microwave frequency of operation.

Figure 3:
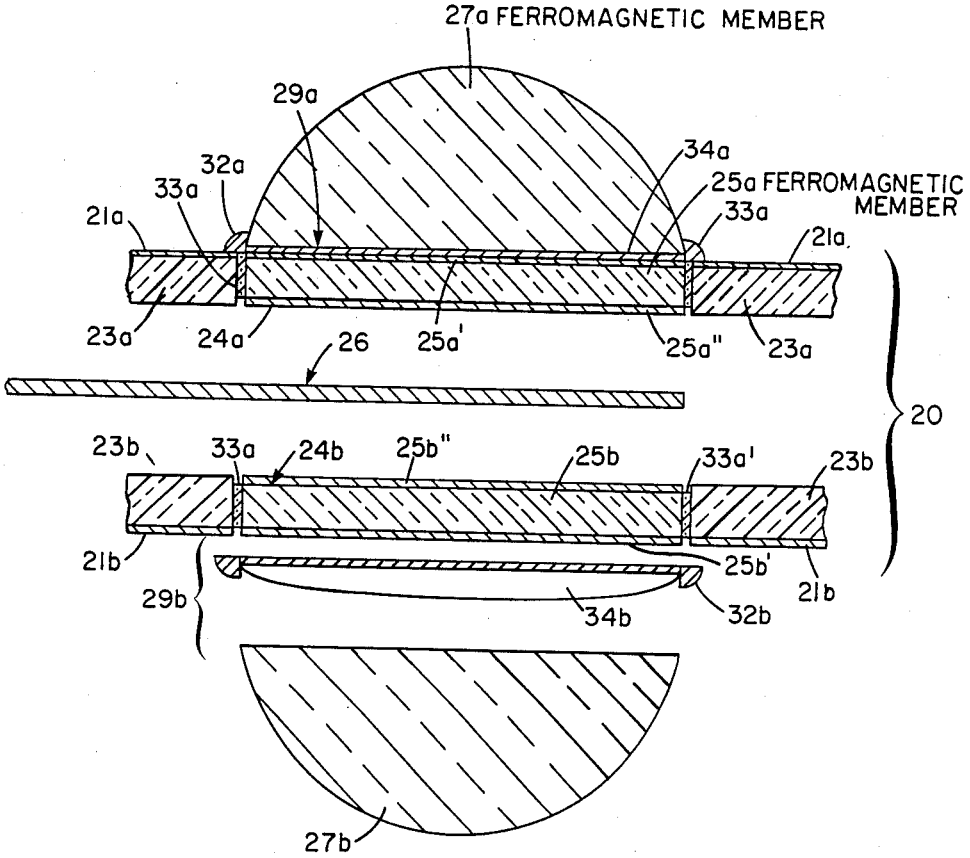
FIG. 3 is an enlarged partially exploded sectional view of a portion of the circulator of FIG. 1 taking along line 3—3 of FIG. 1.

As shown in FIG. 3, a preferred technique to assemble the discs 25*a*, 25*b* with the substrates 23*a*, 23*b* and hemispherical members 27*a*, 27*b* involves providing apertures 24*a*, 24*b* which may receive discs 25*a*, 25*b* having metalized surfaces 25*a*', 25*a*'', 25*b*'; 25*b*''. The discs are held in place with a non-conductive epoxy 33*a*, 33*a*'. The spherical members 27*a*, 27*b* are then attached to the ferrite discs with a conductive epoxy 34*a*, 34*b*. As pressure is applied to the hemispherical member 27*a*, 27*b*, a small bead 32*a*, 32*b* is formed between the metalized surfaces thus insuring electrical continuity between the gound planes 21*a*, 21*b* on the dielectric substrates 23*a*, 23*b*, the ferromagnetic disc metalizations 25*a*', 25*b*', and the ferromagnetic hemisphere metalization 27*a*', 27*b*', thus forming layers 29*a*, 29*b* shown in FIG. 1.

Circulators are generally operated in a mode in which the magnetic field strength inside the ferrite disc is small compared to $4\pi M_s$. It has been found that the performance of such circulators is unsatisfactory at frequencies lower than $f_m$ because of excessive insertion loss. This so-called "low field loss" effect can be attributed to the magnetic field through the ferromagnetic disc of the circulator being larger near the perimeter of the disc than near the center of the disc. This implies that when the strength of the applied field is adjusted to the optimal value at which a local resonant frequency is zero near the disc center, the resonant frequency is approximately equal to $(\sqrt{3}/2)f_M=0.87\ f_M$ near the disc perimeter. A material with an infinitely narrow resonance line would thus show resonant absorption at all frequencies less than $0.870\ f_M$. For materials used in practice, however, the absorption will become noticeable at frequencies near $f_M$.

After careful analysis of previous theoretical work in the field of microwave circulators, particular that described by Wu and Rosenbaum, "Wideband Operation of Microstrip Circulators" MTT-22, pages 849–856, October 1974, I have determined that useful circulator performance at frequencies lower than $f_M$ is possible. Under the generally accepted operating conditions of a circulator, the effective permeability $\mu eff=\mu^2-\kappa^2/\mu$, where $\mu$ and $\pm j\kappa$ are the components of the permeability tensor, $\overline{\overline{\mu}}$, and where $\mu eff$ is negative for frequencies $f<f_M$ when the internal magnetic field strength is very small. The theories developed by Wu and Rosenbaum and their predecesors apply for $f>f_M$, but do not recognize that satisfactory circulator performance may be provided at frequencies $f<f_M$ if the internal D.C. magnetic field in the disc 25*a*, 25*b* is uniform.

Non-optimized broad-band stripline circulators such as described in conjunction with FIGS. 1–3 were built to demonstrate operation below $f_M$ with such ferrites using yttrium iron garnet (example No. 1) and lithium ferrite (example No. 2) Yttrium iron garnet has a $f_M$ approximately equal 5 GHz, whereas the lithium ferrite has a $f_M$ approximately equal to 10.4 GHz.

With YIG as the ferromagnetic material, circulator performance with low insertion loss less than about −1 db, isolation between ports greater than −10 db, and reflection better than −10 db were provided in the frequency band from approximately 2.8 GHz to 10.2 GHz, as shown in FIGS. 5A–5C, whereas with the lithium ferrite, the band extended from approximately 5.8 GHz to 18 GHz, as shown in FIGS. 7A–7C.

EXAMPLE NO. 1

The single crystal YIG discs 25*a*, 25*b* had a [100] crystal axis normal to the disc surface, a diameter of 0.24 inches and a height of 0.025 inches. The polycrystalline YIG domes 27*a*, 27*b* were ground into the desired nearly hemispherical shape by means of a suitable grinding tool. The metal central conductor 26 was fabricated photolithographically from copper foil 0.005 inches thick and the conductive layers 21a, 21b between the YIG discs 25a, 25b and the YIG domes 27a, 27b was copper foil approximately 0.0005 inches thick. The other relevant parameters of the circulator with the disc 25a, 25b comprised of YIG were as given in Table I.

TABLE I

| Property | Value |
|---|---|
| Dielectric Constant of Ferrite | $\epsilon_M$ = 14 |
| Dielectric Constant of Substrate | $\epsilon_d$ = 10 |
| Magnetization Frequency | $f_M$ = 4.99 GHZ |
| Magnetization Field Frequency | $f_h$ = 0 |
| Coupling Angle $\psi$ | 0.75 rad = 43° |
| Disc Radius (R) | 3 mm = 0.118 inches |
| Stripline Height B | 1.25 mm = 0.050 inches |
| Outer Strip Width ($w_1$) | .25 mm = 0.01 inch |
| Inner Stripline Width ($w_2$) | 4.17 mm = 0.164 inches |
| Length of Taper (L) | 72 mm = 2.835 inch |

The coupling angle $\Psi$ as shown in FIG. 2 required for broad-band performance is typically quite large, approximately equal to 0.75 radians or larger. The inner stripline width $w_2$, the disc radius R and the coupling angle $\Psi$ are related as $w_2=2R \sin \Psi$. The stripline width w calculated from the equation above is relatively large, here for example 0.164 inches and the characteristic impedance of such a stripline is relatively small, approximately equal to 8 ohms. Suitable distributed or lumped element matching circuits are required in order to connect the circulator to striplines or other transmission line mediums having 50 ohm characteristic impedances.

FIGS. 5A–5C show the insertion loss, isolation, reflection as measured between 2 and 12 GHz, for the circulator of example 1. Suitable circulator performance was obtained over a frequency band between 2.8 and 10 GHz. At the lower edge of this band, insertion loss rises gradually to 2 dB, but approximately 1 dB of this loss is attributable to reflections caused by impedance mismatch between the system impedance 50 ohms and the circulator impedance 8 ohms. It should, therefore, be possible to improve the insertion loss at the lower portion of the range by better matching between the 50 ohm characteristic impedance of the system and the 8 ohm characteristic impedance of the stripline circulator 10, as mentioned above. Therefore, the data in FIGS. 5A–5C shows that good circulator performance is possible for frequencies less than $f_M$ i.e. in the region previously thought to be forbidden by prior theory without adversely affecting performance at the upper end of the band. The bandwidth of the present experimental circulator is almost 2 octaves and the normalized bandwidth normalized with respect to the center frequency is 113%.

Figure 6:
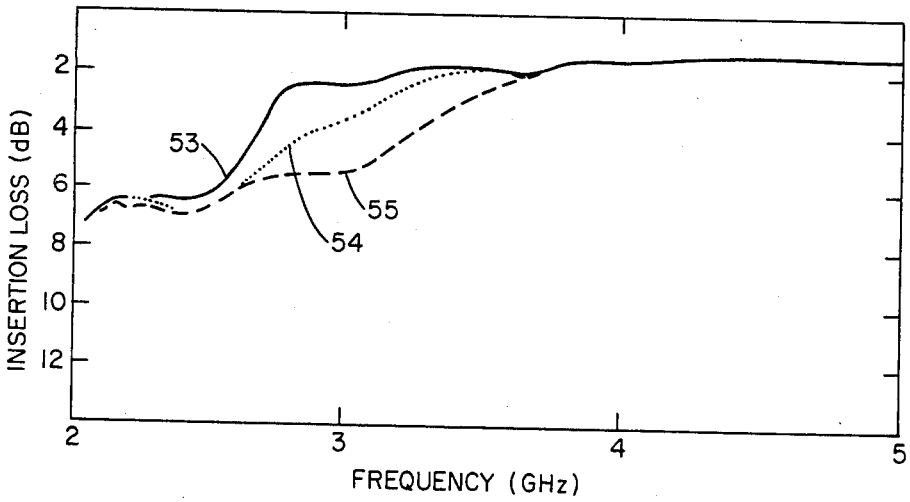
FIG. 6 is a plot of insertion loss versus frequency for the circulator generally described in conjunction with FIGS. 1–3 with the external ferrite domes present and removed which indicates the effect of the domes on the insertion loss of the circulator.

Referring now to FIG. 6, the effect of the ferrite hemispherical members 27a, 27b on circulator performance is shown by comparison of measurements of the insertion loss versus frequency at various field strengths with and without the domes 27a, 27b provided in the circulator of FIGS. 1–3. With the domes in place, an applied field of 0.6 kG is expected to result in an internal field near zero (since $4\pi M_s$ is approximately equal to 1.75 kG and the demagnetization factor for a sphere is one-third). The insertion loss obtained under these conditions is shown as curve 53 in FIG. 6. With the domes not present, the demagnetization factor of the two discs is approximately 0.8. Thus, an applied field of 1.45 kG should result in a near 0 internal magnetic field near the center of disc 25a, 25b. The insertion loss obtained under these condition, as shown as a dashed line in FIG. 6 as curve 55 is substantially larger (for 2.3 GHz<f<3.76 Hz) than the insertion loss obtained with the domes 27a, 27b in place. It was found that the insertion loss obtained without the domes could be somewhat reduced by using a smaller applied magnetic field H=1.2 kG. The insertion loss obtained under these conditions is shown as a dotted line curve 54 of FIG. 6 and falls between the results obtained in the above mentioned cases.

This experiment demonstrates that the use of the ferrite hemispherical domes over the ferrite discs improves substantially the uniformity of the magnetic field in the interior of the ferrite discs and, thereby provides improved circulator performance at frequencies f less than $f_M$.

EXAMPLE NO. 2

A second circulator using lithium ferrite was constructed. The circulator construction was similar to that constructed for the YIG garnet example. However, since the expected operating frequency is about twice as large for a lithium ferrite than for the YIG material, dimensional changes were made, as set forth in Table II. The lithium ferrite discs were single crystal with a [100] axes normal to the disc's face. The domes 27a, 27b were polycrystalline lithium ferrite. FIGS. 7A–7C set forth measurements of insertion lsss, isolation, and reflections between ports in the frequency range from 5 to 20 GHz. The curves are very similar to the YIG circulator except that the frequency bandwidth is shifted up by a factor of about 2 owing to the high magnetization frequency of lithium ferrite.

TABLE II

| Property | Value |
|---|---|
| Dielectric Constant of Ferrite | $M$ = 16 |
| Dielectric Constant of Substrate | $d$ = 10 |
| Magnetization Frequency | $f_M$ = 10.36 GHZ |
| Magnetization Field Frequency | $f_h$ = 0 |
| Coupling Angle ($\psi$) | 0.75 rad = 43° |
| Disc Radius (R) | 1.5 mm = 0.059 inches |
| Stripline Height (B) | 1.25 mm = 0.050 inches |
| Outer Strip Width ($w_1$) | 0.25 mm = 0.01 inches |
| Inner Stripline Width ($w_2$) | 2.04 mm = 0.080 inches |
| Length of Taper (L) | 41 mm = 1.6 inches |

Figure 8:
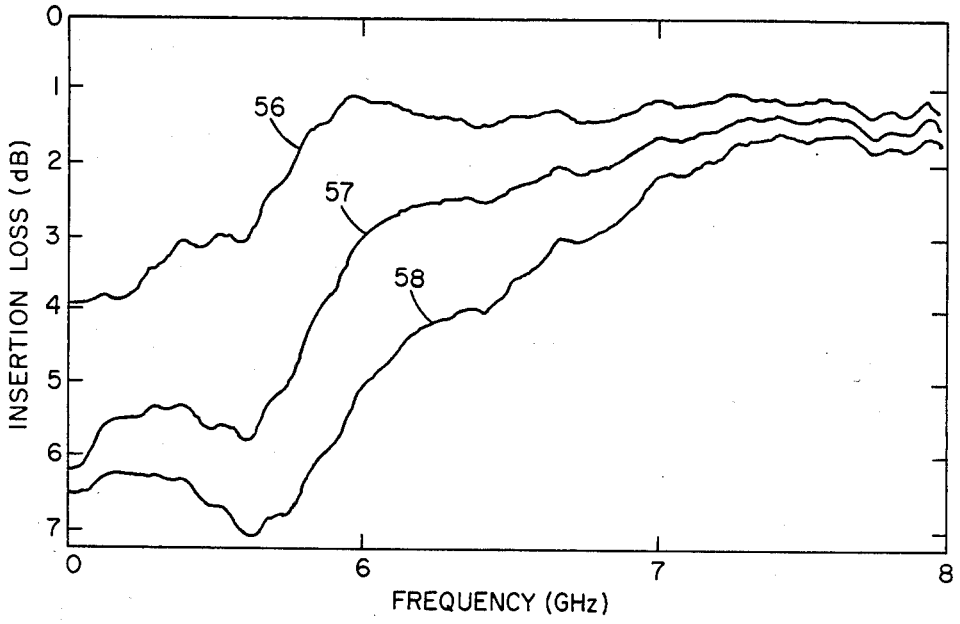
FIG. 8 is a plot of insertion loss versus frequency for circulator generally described in conjunction with FIGS. 1–3 using lithium ferrite with and without domes present which indicates the effect of the domes on the insertion loss of the circulator.

FIG. 8 illustrates the effect of the external ferrite domes on insertion loss for the circulator fabricated with Li ferrite. The lower insertion loss was measured (curve 56) with the external domes 27a, 27b present and the external magnetic field adjusted to approximately 1,600 Oe. This value of magnetic field is consistent with the saturation magnetization ($4\pi M_s$ approximately equal to 3700 Oe) and anistropic field ($H_a$ approximately equal to 500 Oe for this material). For a perfect sphere in the (100) orientation, the effective internal magnetic field would be 0 when the external field equals $4\pi M_s/3+Ha=1733$ Oe. The actual shape of the composite sphere (discs plus domes) was that of a slightly elongated sphere which accounts for the small difference between the field values in which optimum performance is expected and those in which it is actually observed. FIG. 8 also illustrates that with the domes 27a, 27b removed and the applied field at 1600 Oe, the insertion loss as shown by curve 58 has increased substantially. An intermediate situation exists as with the YIG example without the domes 27a, 27b present, when the field is adjusted to obtain the best response here at a value of approximately 2,000 Oe, as shown by curve 57.

Curves 56–58 demonstrate that the hemispherical members 27a, 27b increase the internal magnetic DC field uniformity in the ferrite discs 25a, 25b over the band of operation and that the increase in uniformity of the magnetic field in said discs 25a, 25b improves circulator performance substantially.

With better matching which can be achieved by multistaged quarter wave transformers and use of thicker dielectric substrates for example, it is expected that an optimized circulator may be fabricated from YIG or Li ferrite, for example, having insertion loss approximately 0.5 dB higher than the minimum shown in FIG. 4A, isolation as shown in FIG. 4B, and reflection as shown in FIG. 4C.

Figure 9:
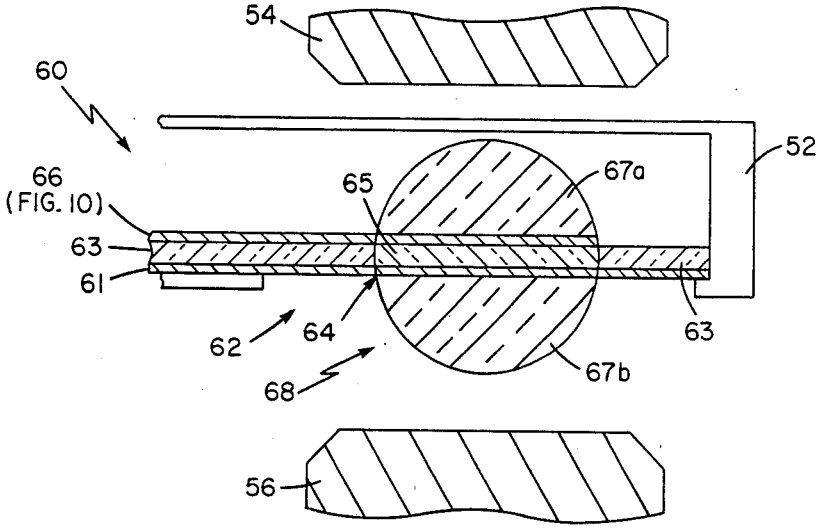
FIG. 9 is a cross-sectional view of a microstrip type circulator having means for increasing the DC magnetic field uniformity.
Figure 10:
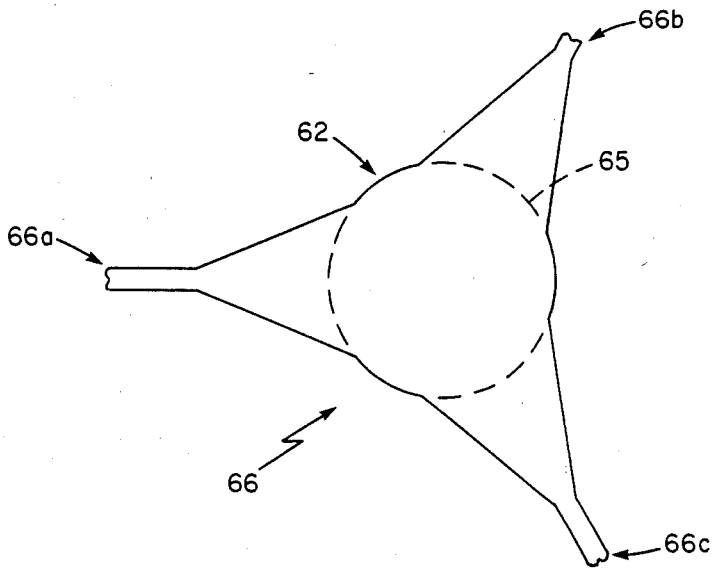
FIG. 10 is a plan view of a central conductor used in the circulator of FIG. 9.

Referring now to FIG. 9, an alternate embodiment of a circulator having means for increasing the internal D.C. magnetic field uniformity within a ferromagnetic disc 65 disposed at the junction of said circulator 60 is shown in microstrip form. Here the circulator 50 includes, a circulator circuit 62 comprising a dielectric substrate 63, a ground plane 61 disposed over a first surface of said substrate 63, and a patterned strip conductor 66 having ports 66a–66c (as shown in FIG. 10) disposed over a second surface of the substrate 63. An aperture 64 is provided through the dielectric substrate 63, and has disposed therein a ferromagnetic disc member 65. Disposed over ferromagnetic disc member 65 are a pair of hemispherical members 67a, 67b comprised of a ferromagnetic material which provide in combination with disc member 65 a composite ferromagnetic ferrite member 68 having a substantially spherical shape. Improved circulator broadband frequency performance is also provided from this arrangement since again the internal DC magnetic field within the ferrite member 65 is substantially more uniform due to the presence of the hemispherical members 67a, 67b.

Figure 11:
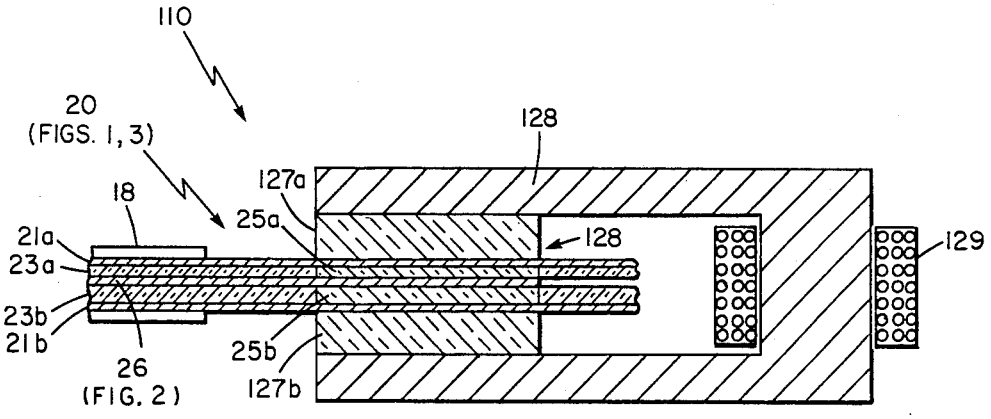
FIG. 11 is a cross-sectional view of an alternate embodiment of a stripline circulator having means for increasing internal DC field uniformity.
Figure 12:
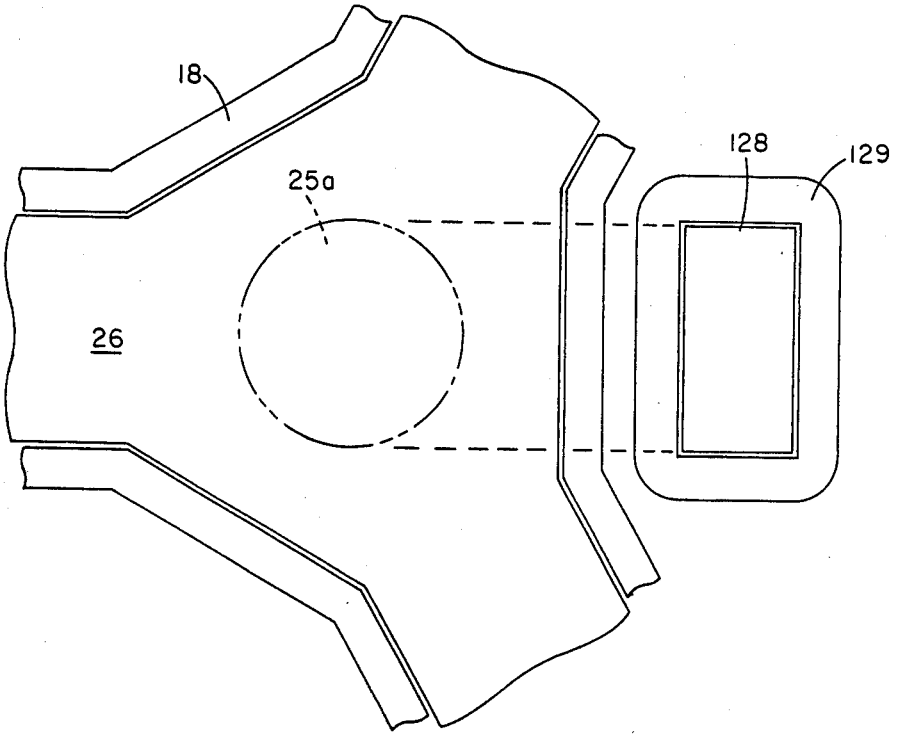
FIG. 12 is a cross section through the mid plane of the circulator of FIG. 11.

Referring now to FIGS. 11 and 12, a further alternate embodiment of the invention here a compact, stripline circulator 110 having circulator performance below $f_M$ is shown, although it will now be appreciated that a microstrip version of the circulator may also be provided. One of the drawbacks in some applications of the configurations mentioned previously is the relatively large magnetic structure required due to the presence of the hemispherical dome members 27a, 27b (FIG. 1) or 67a, 67b (FIG. 9). Accordingly, as shown in FIG. 11, the relatively large hemispherical members are replaced by a second pair of ferrite disc members 127a, 127b; and a closed flux return path 128 provided by high permeability magnetic material such as permalloy is disposed in contact with the second , pair of ferrite disc members 127a, 127b. An electromagnetic coil 129 is disposed around a portion of the permalloy structure, as shown. The coil is provided to generate the proper field strength $H_{DC}$ in the ferrite discs 25a, 25b of the circulator member 20. Again, however, when the DC magnetic field is directed through the ferrite disc members 25a and 25b, the internal DC magnetic field therein will be substantially uniform due to the presence of the externally mounted ferrite members 127a, 127b and the flux return path 128.

Having described preferred embodiments in the invention, it will now become apparent to one of the skill in the art that other embodiments incorporating their concepts may be used. It is felt, therefore, that these embodiments should not be limited to disclosed embodiments, but rather should be limited only to by the spirit and scope of the appended claims.

What is claimed is:

1. In combination:

a propagation medium;

first means, including a disc comprised of a ferromagnetic material having a saturation magnetization characteristic, said disc being disposed within said propagation medium, for providing non-reciprocal ferromagnetic action having a predetermined low limit frequency of operation relative to the magnetization frequency of the ferromagnetic material; and second means, disposed outside of said propagation medium, for providing nonreciprocal ferromagnetic action at frequencies substantially below the magnetization frequency $f_M$ of the ferromagnetic material, said means including a pair of members comprised of a ferromagnetic material having the same saturation magnetization as that of the ferromagnetic material of the disc disposed in said propagation medium.

2. The combination of claim 1 wherein said means for providing nonreciprocal ferromagetic action substantially below $f_M$, provides a substantially uniform internal D.C. magnetic field in the ferromagnetic material.

3. The combination of claim 2 wherein said pair of members are discs, and said second means for providing nonreciprocal ferromagnetic action substantially below $f_M$ includes:

means for providing a high permeability closed flux return path having an air gap, with said propagation medium, and said first means for providing nonreciprocal ferromagnetic action disposed in said air gap.

4. The combination of claim 5 wherein the ferromagnetic materials are selected from the group consisting of garnets and ferrites.

5. The combination of claim 4 wherein said propagation medium comprises:

a dielectric having an aperture having disposed therein the ferromagnetic disc;

a patterned strip conductor disposed over one surface of the dielectric and ferromagnetic disc; and a ground plane conductor disposed over a second opposite surface of the dielectric.

6. The combination of claim 1 wherein said propagation medium comprises:

a dielectric having an aperture having disposed therein the ferromagnetic disc;

a patterned strip conductor disposed over one surface of the dielectric and ferromagnetic disc; and a ground plane conductor disposed over a second opposite surface of the dielectric.

7. The combination of claim 6 further comprising:

means for providing a D.C. magnetic field through said first means for providing nonreciprocal ferromagnetic action and said second means for providing nonreciprocal ferromagnetic action.

8. The combination of claim 7 wherein said members are arranged to provide a uniform D.C. internal field in said ferromagnetic disc in response to said D.C. magnetic field means.

9. The combination of claim 2 wherein said pair of members of said second means is a pair of hemi-ellipsoidial members disposed over said ferromagnetic disc of said first means.

10. The combiantion of claim 9 wherein said hemi-ellipsoidial members are hemispherical members disposed over said ferromagnetic disc to form in combination with said ferromagnetic disc, a substantial spherical composite ferromagnetic body.

11. the combination of claim 10 wherein the materials of said hemispherical members and said disc are selected from the group consisting of garnet and ferrites.

12. The combination of claim 11 wherein said propagation medium comprises:

a dielectric having an aperture having disposed therein the ferromagnetic disc;

a patterned strip conductor disposed over one surface of the dielectric and ferromagnetic disc; and a ground plane conductor disposed over a second opposite surface of the dielectric.

13. The combination of claim 12 further comprising:

means for providng a D.C. magnetic field through said first means for providing nonreciprocal ferromagnetic action and said second means for providing nonreciprocal ferromagnetic action.

14. The combination of claim 2 wherein said propagation medium comprises:

a patterned strip conductor;

a pair of dielectrics, disposed over opposing surface of said patterned strip conductors, with said dielectric each having an aperture;

a pair of ground planes spaced from said patterned strip conductors by said dielectric; and wherein said first means includes:

a pair of ferromagnetic discs disposed in the apertures of said pair of dielectrics.

15. The combination of claim 14 wherein said pair of members are discs, and said second means for providing nonreciprocal ferromagnetic action substantially below $f_M$ further includes:

means for providing a high permeability closed flux return path having an air gap, with said propagation medium, and said first means for providing nonreciprocal ferromagnetic action disposed in said air gap.

16. The combination of claim 14 wherein said pair of members of said second means is a pair of hemi-ellipsoidial members disposed over said ferromagnetic disc.

17. The combination of claim 16 wherein said hemi-ellipsoidial members are hemispherical members disposed over said pair of ferromagnetic discs to form in combination with said ferromagnetic discs, a substantial spherical composite ferromagnetic body.

18. A nonreciprocal microwave device comprising:

a central patterned conductor;

a pair of dielectrics, each having an aperture disposed in said dielectric and each one of said dielectrics being disposed over a surface of said patterned central conductor;

a pair of outer conductors disposed on opposing second surfaces of said pair of dielectrics;

a first pair of discs comprised of a ferromagnetic material said material having a saturation magnetization characteristic disposed in the respective apertures in said pair of dielectrics; and means, including a pair of members comprised of a ferrite material having the same saturation magnetization as that of the pair discs disposed adjacent said pair of ferrites, for providing a substantially uniform DC magnetic field through said ferrites.

19. The device of claim 18 wherein said pair of members is a second pair of ferromagnetic disc disposed over the first pair of discs, and said means further includes:

a high permeability flux return path with said first and second pairs of discs being disposed in said path.

20. The device of claim 18 wherein said means includes a pair of hemi-ellipsoidial members.

21. The device of claim 20 wherein said hemi-ellipsoidial members are hemispherical members.

22. The device of claim 21 wherein said pair of hemispherical members and first pair of discs provide a composite substantially spherical ferromagnetic body.

23. The device of claim 18 wherein the ferromagnetic material is selected from the group consisting of the garnets and the ferrites.

24. The device of claim 19 wherein the ferromagnetic material is selected from the group consisting of the garnets and the ferrites.

25. The device of claim 20 wherein the ferromagnetic material is selected from the group consisting of the garnets and the ferrites.

26. The device of claim 21 wherein the ferromagnetic material is selected from the group consisting of the garnets and the ferrites.

27. The device of claim 22 wherein the ferromagnetic material is selected from the group consisting of the garnets and the ferrites.

28. A nonreciprocal microwave device, comprising:

a patterned conductor;

a dielectric supporting said patterned conductor over a first surface, said dielectric having an aperture;

a second conductor disposed over a second surface of said dielectric;

a disc comprised of a ferromagnetic material disposed in the aperture provided in said dielectric; and means, including a pair of hemi-ellipsoidial ferromagnetic members disposed over said disc, for providing a substantially uniform magnetic field in said ferrimagnetic disc.

29. The device of claim 28 wherein the pair of hemi-ellipsoidial ferromagnetic members and the ferromagnetic disc are comprised of ferromagnetic materials having the same saturation magnetization.

30. The device of claim 28 wherein the means for providing the uniform magnetic field comprises a pair of substantially hemispherical members disposed over said ferromagnetic disc to provide in combination with said disc a substantially spherical composite ferromagnetic body.

31. The device of claim 30 wherein said ferromagnetic materials are selected from the group consisting of the ferrites and the garnets.

* * * * *